US008306067B2

(12) United States Patent
Di et al.

(10) Patent No.: US 8,306,067 B2
(45) Date of Patent: Nov. 6, 2012

(54) DUAL-FREQUENCY MULTIPLEXER

(75) Inventors: Yingjie Di, Guangzhou (CN); Tao He, Guangzhou (CN); Bin He, Guangzhou (CN); Mengmeng Shu, Guangzhou (CN); Jingmin Huang, Guangzhou (CN)

(73) Assignee: Comba Telecom System (China) Ltd. (CN)

( * ) Notice: Subject to any disclaimer, the term of this patent is extended or adjusted under 35 U.S.C. 154(b) by 347 days.

(21) Appl. No.: 12/668,298

(22) PCT Filed: Apr. 11, 2007

(86) PCT No.: PCT/CN2007/001161

§ 371 (c)(1),
(2), (4) Date: Jan. 8, 2010

(87) PCT Pub. No.: WO2008/110040

PCT Pub. Date: Sep. 18, 2008

(65) Prior Publication Data

US 2010/0278197 A1 Nov. 4, 2010

(30) Foreign Application Priority Data

Mar. 12, 2007 (CN) ..... 2007 1 0027116

(51) Int. Cl.

| | |
|---|---|
| ***H04J 1/00*** | (2006.01) |
| ***H03D 7/16*** | (2006.01) |
| ***H03D 5/00*** | (2006.01) |
| ***H03D 3/00*** | (2006.01) |
| ***H04B 7/12*** | (2006.01) |
| ***H04L 27/14*** | (2006.01) |
| ***H03K 3/03*** | (2006.01) |

(52) U.S. Cl. ..... 370/480; 370/532; 370/535; 370/537; 455/131; 455/141; 455/146; 455/196.1; 455/208; 455/227; 455/323; 455/339; 329/302; 329/323; 329/324; 331/2; 331/23; 331/47; 331/48

(58) Field of Classification Search ..... 370/480, 370/532, 535, 537; 455/131, 141, 144, 146, 455/147, 150.1, 192.1, 193.1, 196.1, 208, 455/227, 255, 258, 265, 315, 316, 323, 334, 455/339; 327/39–49, 551–559, 565, 567; 329/301–302, 323–324; 331/2, 18, 23, 29, 331/36 C, 40, 47, 48, 52, 54, 76, 108 C, 117 D; 333/218; 342/193, 195, 199, 200
See application file for complete search history.

(56) References Cited

U.S. PATENT DOCUMENTS

| | | | | |
|---|---|---|---|---|
| 5,712,641 | A * | 1/1998 | Casabona et al. | 342/362 |
| 6,892,056 | B1 * | 5/2005 | Garmonov et al. | 455/75 |
| 2001/0004225 | A1 * | 6/2001 | Nicholls et al. | 331/34 |
| 2007/0131651 | A1 * | 6/2007 | Goto et al. | 216/63 |
| 2010/0244982 | A1 * | 9/2010 | Di et al. | 333/132 |
| 2010/0254366 | A1 * | 10/2010 | Shu et al. | 370/342 |
| 2010/0278197 | A1 * | 11/2010 | Di et al. | 370/480 |

FOREIGN PATENT DOCUMENTS

| | | | |
|---|---|---|---|
| CN | 1365582 | A | 8/2002 |
| CN | 2595111 | Y | 12/2003 |
| CN | 2657318 | Y | 11/2004 |
| EP | 1569333 | A1 | 8/2005 |

* cited by examiner

OTHER PUBLICATIONS

International Search Report, PCT/CN2007/001161, dated Dec. 20, 2007.

*Primary Examiner* — Michael Thier
*Assistant Examiner* — Benjamin H Elliott, IV
(74) *Attorney, Agent, or Firm* — Lerner, David, Littenberg, Krumholz & Mentlik, LLP

(57) ABSTRACT

The invention discloses a dual frequency multiplexer by which a first and second coaxial harmonic oscillator type band pass filters are disposed in a box. The box includes a base body, a cover plate and a cover body. The two coaxial harmonic oscillator type hand pass filters are located on the base body and spaced each other by a metal plate; the multiplexer port, first and second ports are positioned on lateral side of the base body. The blocking capacitors are contained in the coaxial chamber of the two coaxial harmonic oscillator type band pass filters. The cover plate is secured on the base body; the first and second direct current circuits are placed on the cover plate; the low pass filters of the first and second direct current circuits are fixed on an edge of a top surface of the coaxial chamber by means of a support member; the cover body and the base body are fastened with each other. The blocking capacitors each are of distributed parameter capacitor. Utilization of distributed blocking capacitors makes the product of the invention small. Moreover, improvement of the structure of the invention brings effect such as less differential loss, large power capacity, as well as high isolation degree between circuits.

9 Claims, 4 Drawing Sheets

DUAL-FREQUENCY MULTIPLEXER

CROSS REFERENCE TO RELATED APPLICATIONS

The present application is a national phase entry under 35 U.S.C. §371 of International Application No. 2007/CN2007/001161 filed Apr. 11, 2007, published in Chinese, which claims the benefit of Chinese Patent Application No. 200710027116.4, filed Mar. 12, 2007. The disclosures of said applications are incorporated by reference herein.

FIELD OF THE INVENTION

The invention relates to a processing device for multiplexing between the second generation and third generation communication systems, and more particularly relates to dual frequency multiplexer.

BACKGROUND OF THE INVENTION

With rapid development of mobile communications, a scheme in which multiple systems share a common station as well as a common antenna feeder resource has gotten its population by more and more operators. By this way, advantage of sharing resource and reducing system device cost can be obtained. Within a system in which 2G/3G sharing a common antenna feeder, dual frequency multiplexer is a necessary microwave component that mainly serves to multiplex/de-multiplex signals of different systems so as to save the length of feed cable, simplify system construction and reduce cost. In addition, power is supplied to the devices at base station tower via a radio frequency cable and accordingly, the multiplexer connected with the feed cable must have the ability of passing direct current there through.

With reference to the schematic diagram of FIG. 1, a multiplexer is a microwave component having three ports, i.e., two direct current feed circuits and two RF signal circuits, wherein each direct current feed circuit is constructed by a lump parameter low pass filter, a switch and a lightning protection device. The low pass filter is used to suppress RF signal at high frequency such that control signal at certain frequency (such as 3 MHz) can pass the filter with ease. The switch serves to selectively conduct direct current there through. The RF signal circuit consists of a blocking capacitor and a band pass filter. The band pass filters of respective two RF signal circuits have their band pass range be set so as to be suited to frequency range of two signals to be multiplexed. During operation, the signal input from a common port Port1 is shunted to Port2 or Port3 according to the frequency range. Alternatively, the signal input from ports Port2 or Port3 may also be combined and output via the port Port1.

The RF signal frequency range of the system in which 2G/30 sharing a common antenna feeder is 806 MHz-960 MHz and 1710 MHz-2170 MHz respectively. By now, to obtain such wide a work frequency band and capability of passing direct current, most multiplex products employ dielectric substrates and realize it by micro-strip circuits. The disadvantages of product of this type include large bulkage and low power capacity. Moreover, inactive inter-modulation is greatly depended on property of dielectric substrate material and therefore, it is difficult to control the dielectric substrate material during batch production.

SUMMARY OF THE INVENTION

One object of the invention is to provide a dual frequency multiplexer which can be minimized in size, reduce differential loss, obtain large power capacity, and have high isolation degree between direct current circuit and RF signal circuit.

To this end, the invention utilizes the following technical scheme.

The dual frequency multiplexer of the invention includes a multiplexer port, a first port used to receive corresponding a first frequency band, a second port used to receive corresponding a second frequency band, two coaxial harmonic oscillator type band pass filters and two direct current circuits.

The first direct current circuit is connected between the first port and the multiplexer port, while the second direct current circuit is connected between the second port and the multiplexer port.

The first coaxial harmonic oscillator type band pass filter is connected electrically with the first port through a first blocking capacitor, while the second coaxial harmonic oscillator type band pass filter is connected electrically with the second port through a second blocking capacitor. The other ends of both first and second coaxial harmonic oscillator type band pass filters are electrically coupled to the multiplexer port by a third blocking capacitor.

The first direct current circuit includes a first low pass filter coupled electrically with the first blocking capacitor, whilst the second direct current circuit includes a second low pass filter coupled electrically with the second blocking capacitor. The first and second direct current circuits share a common third low pass filter which is connected in electrical manner with the third blocking capacitor.

The first and second coaxial harmonic oscillator type band pass filters are disposed in a box including a base body, a cover plate and a cover body. The two coaxial harmonic oscillator type band pass filters are located on the base body and spaced each other by a metal plate. The multiplexer port, first and second ports arc positioned on lateral side of the base body. The blocking capacitors are contained in the coaxial chamber of the two coaxial harmonic oscillator type band pass filters. The cover plate is secured on the base body. The first and second direct current circuits are placed on the cover plate. The low pass filters of the first and second direct current circuits are fixed on an edge of a top surface of the coaxial chamber by means of a support member. The cover body and the base body are fastened with each other.

Preferably, a gap with a width not less than 0.2 mm is defined between the top surface of the support member and a bottom surface of the cover plate in order to maintain good electrical. performance of the RF signal.

Preferably, the blocking capacitors each are of distributed parameter capacitor.

More particularly, each blocking capacitor includes an inner conductor, an insulator and a sleeve. The insulator surrounds the inner conductor at outer perimeter thereof, while the sleeve surrounds the outer perimeter of the insulator. The sleeve serves to electrically connect the first and/or second coaxial harmonic oscillator type band pass filter. The inner conductor is used to connect electrically with the first and/or second direct current circuits so as to be connected with an adjacent port.

The first and second coaxial harmonic oscillator type band pass filters each a coaxial chamber and a plurality of harmonic posts arranged in the chamber sequentially. For the two coaxial harmonic oscillator type band pass filters, a ridge is disposed between two adjacent harmonic posts for purpose of enhancing coupling effect. Preferably, the first coaxial harmonic oscillator type band pass filter has 5 harmonic posts, while the second coaxial harmonic oscillator type band pass filter has 6 harmonic posts.

Furthermore, corresponding to the two coaxial harmonic oscillator type band pass filters, the cover plate has several turning screws which pass through the cover plate and extend into the two coaxial chambers with the aim of adjustment of tuning frequency and coupling degree of the coaxial harmonic oscillators.

The cover plate further has a through hole defined therein with which a Gore permeable film is covered.

Compared with prior art, the invention can obtain the following advantages. The 2G/3G dual frequency multiplexer of the invention is implemented by a plurality of coaxial harmonic oscillator type band pass filters. By this way, the direct current circuit and the RF circuit are isolated from each other. Utilization of distributed blocking capacitors makes the product of the invention small. Moreover, improvement of the structure of the invention brings effect such as less differential loss, large power capacity, as well as high isolation degree between circuits.

DETAILED DESCRIPTION OF THE INVENTION

Figure 2:
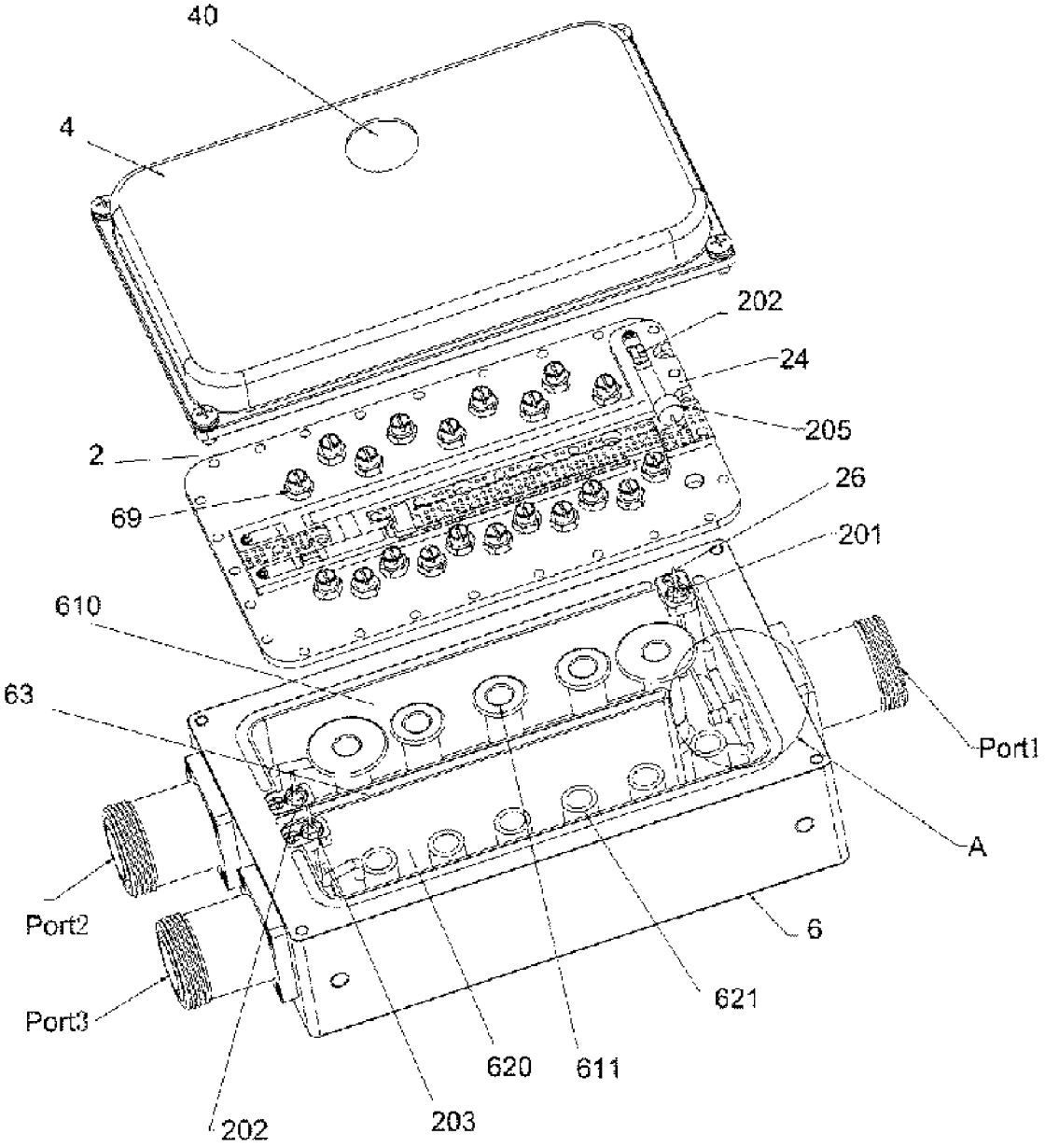
FIG. 2 illustrates a perspective view of the product of the invention.
Figure 3:
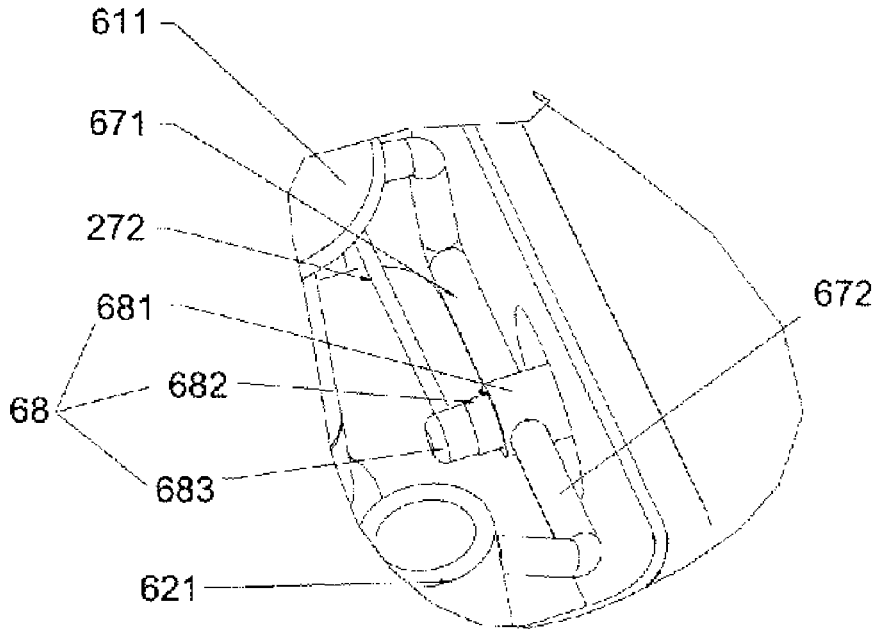
FIG. 3 illustrates an enlarged view of portion A of FIG. 2.

With reference to FIG. 2, a dual frequency multiplexer of the invention is shown, which is used mainly to multiplex 2G and 3g signals.

As shown in FIG. 2, the multiplexer is of a box type, and is constructed by a base body 6, a cover plate 2 and a cover body 4 collectively.

A first port Port2 and a second port Port3 are provided at left side of the base body 6, both of which are adapted to receive radio frequency (RF) signals with frequency of 806-960 MHz and 1710-2170 MHz respectively. A multiplexer port Port1 is located at the right side of the base body 6. The multiplexer port Port1 is able to output RF signal multiplexed by the first and second ports (Port2 and Port3). Alternatively, an input signal can be de-multiplexed through the first and second ports (Port2 and Port3).

Two RF circuits, that is, a first RF circuit and a second RF circuit are integrated in the base body 6. The first RF circuit is consisted of the first port Port2, a blocking capacitors (not shown, see a third blocking capacitor 68), two coaxial harmonic oscillator type band pass filters (610 and 611), a third blocking capacitor 68 and a multiplexer port, all of these components being connected with each other electrically. The second RF circuit is consisted of the second port Port3, a second blocking capacitors (not shown, see a third blocking capacitor 68), two coaxial harmonic oscillator type band pass filters (620 and 621), a third blocking capacitor 68 and a multiplexer port, all of these components being connected with each other electrically.

It is clear that each RF circuit includes not only coaxial harmonic oscillator type band pass filters (610 and 611; 620 and 621), but also the third blocking capacitor 68 in common.

Each of coaxial harmonic oscillator type band pass filters (610 and 611; 620 and 621) includes corresponding coaxial chambers 610 and 620 and plural harmonic posts 611 and 621. As illustrated in FIG. 2, a compartment defined in middle portion of the base body 6 is divided into two coaxial chambers 610 and 620 by a metal plate 63. A first coaxial chamber 610 is corresponding to the first RF circuit, while a second coaxial chamber 620 is corresponding to the second RF circuit. The separation caused by the metal plate 63 can result in higher isolation between the first and second RF circuits. Five harmonic posts 611 are sequentially arranged in the first coaxial chamber 610. A harmonic post close to the first port Port2 is electrically coupled to the first blocking capacitor (see 68) via a wire, thereby further being coupled with the first port Port2. Another harmonic post located far away from the first port Port2 is electrically coupled to the third blocking capacitor 68 via a wire 671. Similarly, six harmonic posts 621 are sequentially arranged in the second coaxial chamber 620. A harmonic post close to the second port Port3 is electrically coupled to the second blocking capacitor (see 68) via a wire, thereby further being coupled with the second port Port3. Another harmonic post located far away from the second port Port3 is electrically coupled to the third blocking capacitor 68 via a wire 672.

The coaxial chambers 610 and 620 are not completely isolated by the metal plate 63 located between the two coaxial harmonic oscillator type band pass filters (610 and 611; 620 and 621).

The first and second blocking capacitors have the same construction as that of the third capacitor 68. The third capacitor 68 includes an inner conductor 683, an insulator 682 and a sleeve 681. The insulator 682 surrounds the inner conductor 683, while the sleeve 681 surrounds the insulator 682. The insulator 682 is implemented by medium film. The sleeve 681 is electrically coupled with the final posts of respective first and second coaxial harmonic oscillator type band pass filters (610 and 611; 620 and 621). The inner conductor 683 is coupled with the multiplexer port Port1 directly. As such, the sleeve 681 and inner conductor 683 can be isolated from each other by the insulator 682 so as to construct distributed parameter capacitor. For two RF circuits, transmission of RF signal is carried out by coupling between the inner conductor 683 and sleeve 681 with direct current being blocked to pass the sleeve 681, thereby making it possible for the RF circuit to block direct current.

As described above, the first and second blocking capacitors employ the same construction as the third blocking capacitor 68. However, the sleeve of the first blocking capacitor (not shown) is connected only to a harmonic post adjacent the second blocking capacitor, of the first coaxial harmonic oscillator type band pass filter, whilst the sleeve of the second blocking capacitor (not shown) is connected only to a harmonic post adjacent the second blocking capacitor, of the second coaxial harmonic oscillator type band pass filter.

The inner conductors of corresponding blocking capacitors are extended out of and electrically connected with the ports Port1, Port2 and Port3 respectively.

Figure 6:
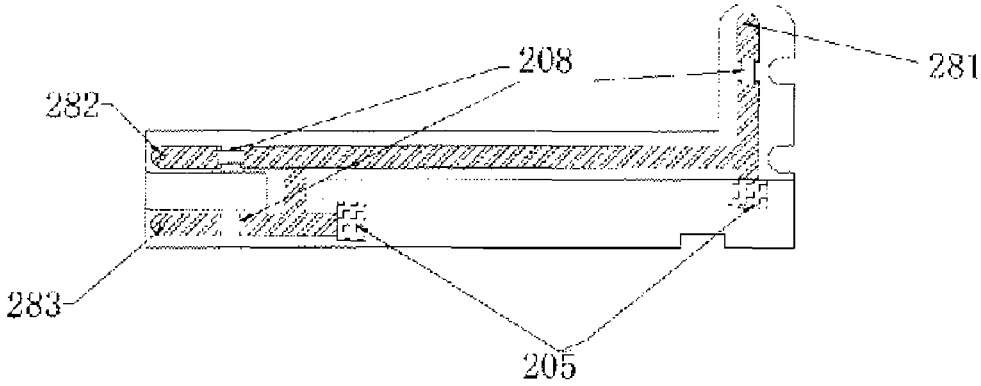
FIG. 6 shows a view of a direct current circuit board of a cover plate of FIG. 2.

The cover plate 2 has a printed circuit board supported thereon. A circuit shown in FIG. 6 is printed on said printed circuit board. The cover plate 2 is just covered on the top surfaces of the two coaxial chambers 610 and 620. Direct circuits of the dual multiplexer are techniques of well known and description thereof is set forth below in brief.

Figure 1:
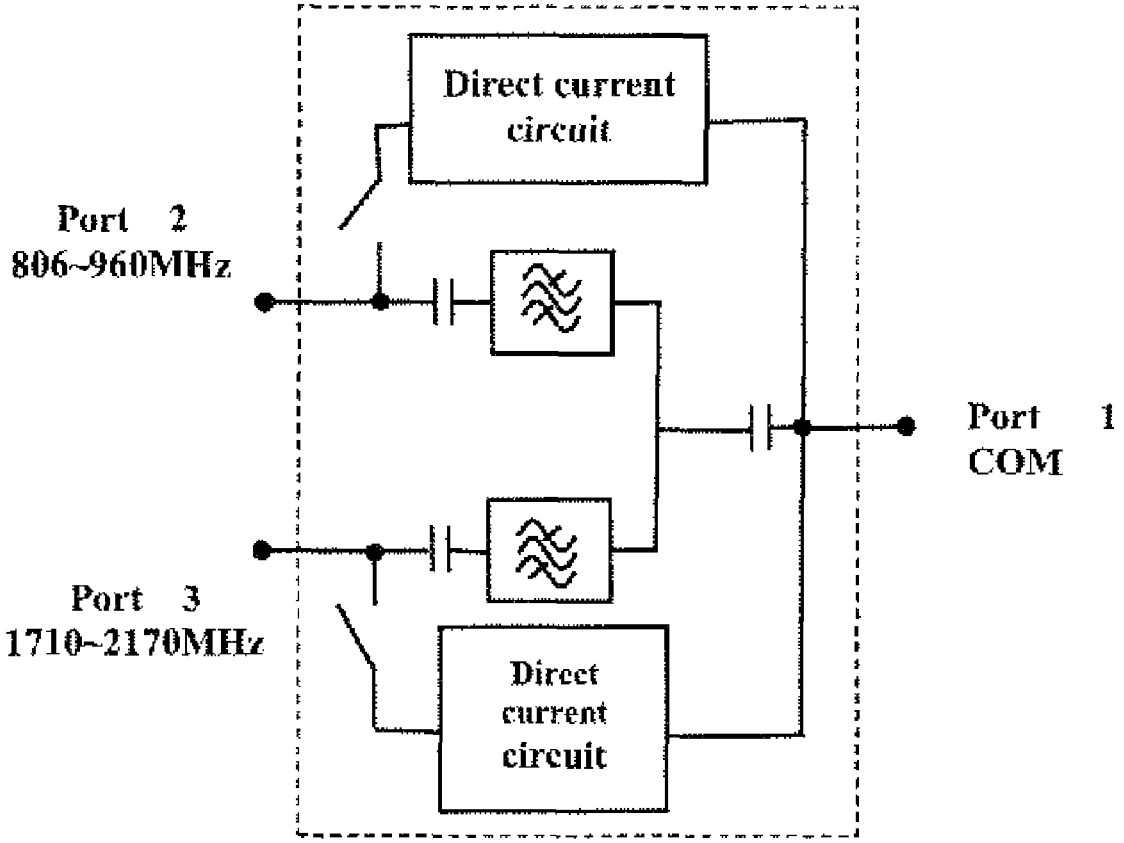
FIG. 1 illustrates a schematic diagram of the invention.

Referring to FIG. 1 and FIG. 6, two direct current circuits, namely a first direct current circuit and a second direct current circuit are incorporated into the cover 2. Each direct current circuit is mainly constructed of low pass filters 201, 202 and 203, switches, lightning protection components 205. Signals coming from the first/second ports Port2/Port3 of the first/ second direct current circuits are filtered by a first/second low pass filter 202/203, then combined together and outputted to the third low pass filter 201, and finally outputted to the multiplexer port Port1. The low pass filters 201, 202 and 203 serve to suppress high frequency signal while permitting transmission of control signal with a frequency less than 3 MHz. Moreover, a switch may be provided between the two direct current circuits depending upon need to determine whether transmission of direct current is allowed. Lightning protection component 205 made of discharging tube may be further provided.

The printed circuit diagram of FIG. 6 shows three connection nodes 281, 282 and 283 of the low pass filters 201, 202 and 203. The low pass filters 201, 202 and 203 are supported independently on three support members. As shown in FIG. 1, the three support members are disposed on top edges of the openings of the two coaxial chambers 610 and 620, and are adjacent to respective ports Port1, Port2 and Port3. Each support member has respective low pass filters 201, 202 and 203 supported thereon.

One ends of respective low pass filters 201, 202 and 203 are connected to blocking capacitors of adjacent ports Port1, Port2, Port3. More specifically, one end of the third low pass fitter 201 is electrically connected with the inner conductor 683 of the third blocking capacitor 68; one end of the first low pass filter 202 is electrically connected with the inner conductor of the first blocking capacitor (not shown); while one end of the second low pass filter 203 is electrically connected with the inner conductor of the second blocking capacitor (not shown). The other ends of the low pass filters 201, 202 and 203 have corresponding contact pads 26 which contact with the connection nodes 281, 282 and 283 of the printed circuit board shown in FIG. 6. Corresponding to three contact pads 26, three holes are defined in the cover plate 2. Engagement of three holes defined in the cover plate 2 with three contact pads 26 ensures fixation between the cover plate 2 and base body 6. At this time, three connection nodes 281, 282 and 283 of the printed circuit board shown in FIG. 6 contact with the contact pads 26 of three low pass filters 201, 202 and 203 of three support members respectively, thus resulting connection of the low pass fillers 201, 202 and 203 with the direct current circuit. A gap with a width not less than 0.2 mm is defined between the top surface of the support member and the cover plate in order to maintain good electrical performance of the RF signal.

The switches are implemented by some magnetic beads 208 welded onto the circuit board to suppress high frequency signal. Disconnection can be established by removing the magnetic beads 28, and resumption of connection can be obtained by placing the same thereon.

As illustrated in FIG. 2, the third low pass filter 201 is electrically coupled with the multiplexer port Port1 by means of connection of the wire 272 with the inner conductor 683 of the third blocking capacitor 68. The same principle applies to the second and third low pass filters 202 and 203. By this way, it is realized that both the direct current circuit and RF circuit are coupled with the multiplexer port Port1.

As illustrated in FIG. 1, several tuning screws 69 are located at two lateral sides corresponding to two coaxial harmonic oscillator type band pass filters (610 and 611; 620 and 621) of the base body 6, of the cover plate 2. Nine tuning screws 69 are disposed at one side corresponding the first coaxial harmonic oscillator type band pass filters (610 and 611); while the number of the tuning screws 69 located at the other side is 11. The tuning screws 69 pass the cover plate 2. When the cover plate 2 and the base body 6 are secured each other, the screws 69 can extend into the interior of the two coaxial chambers 610 and 620. The screws 69 are used to adjust tuning frequency and coupling degree of the coaxial harmonic oscillators (610 and 611; 620 and 621).

Figure 4:
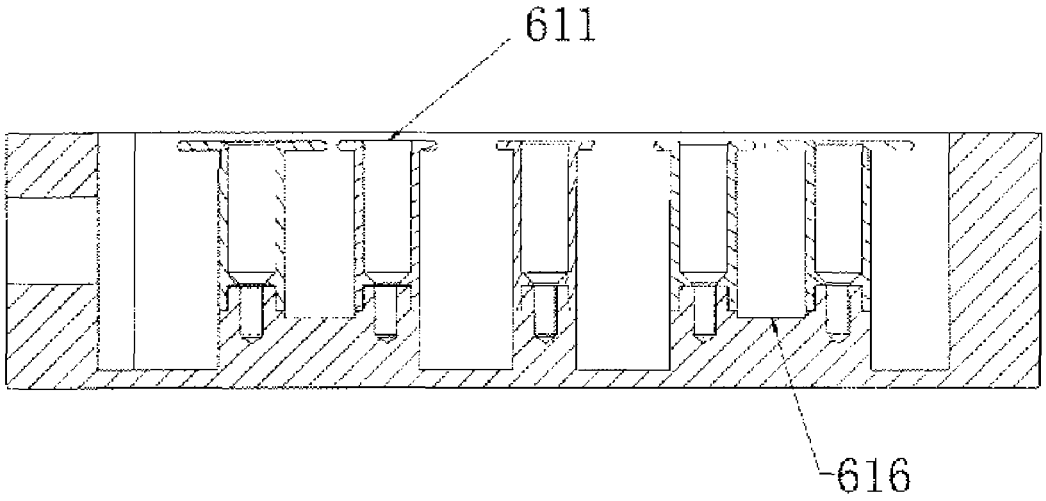
FIG. 4 shows a cross-sectional view of a first coaxial harmonic oscillator type band pass filter of FIG. 2.

With reference to FIG. 4 which is a cross sectional view of the first coaxial harmonic oscillators (610 and 611), and belongs to a first RF circuit between the first port Port2 and the second port Port3. To achieve strong coupling among the harmonic posts 611, a ridge 616 is formed between two adjacent harmonic posts 611. The height of various ridges 616 may vary and be regulated according to certain situation. Further, a disk is provided on top portion of each harmonic post 611. A gap with a width preferably not less than 1.5 mm is defined between the harmonic posts and the cover plate 2. This is for making the size of the coaxial chambers as small as possible during operation of the harmonic posts 611 at a frequency of 806-960 MHz.

Figure 5:
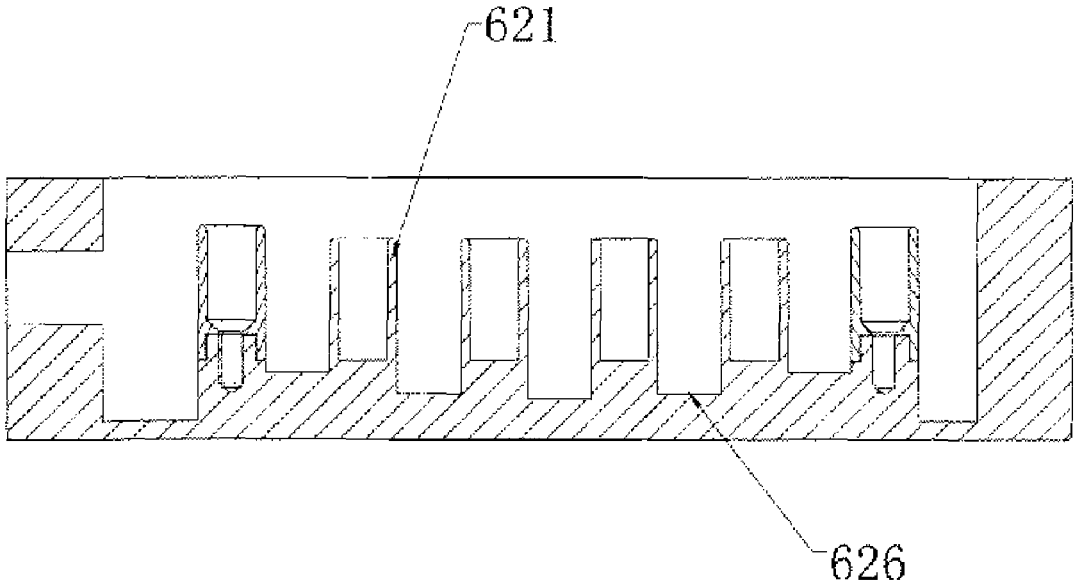
FIG. 5 shows a cross-sectional view of a second coaxial harmonic oscillator type band pass filter of FIG. 2.

With reference to FIG. 5, which is a cross sectional view of the second coaxial harmonic oscillators (620 and 621), and belongs to a second RF circuit between the second port Port2 and the multiplexer port Port1. Similarly, ridges 626 with various heights can be placed between respective harmonic posts 621 so as to obtain strong coupling between the harmonic posts 621. Pass band range is within 1710-2170 MHz.

With reference to FIG. 2 again, which shows the cover body 4 used to cover the base body 6, thereby protecting components inside the base body 6. A rubber ring is provided at the perimeter of the cover body 4 so as to enhance waterproof performance and protect the inner circuit. A Through hole may be defined in the surface of the cover plate 2. A Gore permeable film 40 may be covered on the through hole to keep pressure balance between inside and outside of the base body 6.

In addition, the inner surfaces of the two coaxial chambers 610 and 620 are coated with silver, thereby greatly reducing attenuation of RF signal transmission and keeping insertion loss of the signal within the pass band less than 0.2 dB.

In summary, the invention overcomes drawbacks of prior art and brings advantages as follows.

The size of the dual frequency multiplexer of the invention can be reduced even to 174 mm*105 mm*61 mm. The sleeve typed coupling construction sufficiently utilizes a room through which the inner conductor of the multiplexer port Port1 passes. Therefore, coupling of RF signal is obtained, and no additional space is necessary. Addition of the lump parameter low pass filters between the direct current circuit and RF circuit ensures isolation between the direct current circuit and RF signal circuit, and reduces largely the size of the printed circuit board on the cover plate.

High isolation is realized. Because each RF circuit is of completely sealed waveguide chamber construction, isolation between the circuits is improved largely. The isolation provided by the first port Port1 to RF signal at frequency of 1710-2170 MHz is larger than 85 dB, and the isolation provided by the second port Port3 to RF signal at frequency of 806-960 MHz is larger than 65 dB.

Higher capacity is realized. As a sufficiently wide of gap is defined between each harmonic post within the coaxial chamber and walls of the coaxial chamber, RF signal power support ability of the components is enhanced. Mean power supported by each port is up to 250 watts.

The invention claimed is:

1. A dual frequency multiplexer comprising a multiplexer port, a first port used to receive a first frequency band, a second port used to receive a second frequency band, a first and second coaxial harmonic oscillator type band pass filter, and a first and second direct current circuit, each of said first and second coaxial harmonic oscillator type band pass filters having a coaxial chamber;

the first direct current circuit is connected between the first port and the multiplexer port, while the second direct current circuit is connected between the second port and the multiplexer port;

one end of the first coaxial harmonic oscillator type band pass filter is connected electrically with the first port through a first blocking capacitor, while one end of the second coaxial harmonic oscillator type band pass filter is connected electrically with the second port through a second blocking capacitor; the other ends of both first and second coaxial harmonic oscillator type band pass filters are electrically coupled to the multiplexer port by a third blocking capacitor;

wherein the first direct current circuit includes a first low pass filter coupled electrically with the first blocking capacitor, whilst the second direct current circuit includes a second low pass filter coupled electrically with the second blocking capacitor; the first and second direct current circuits share a common third low pass filter which is connected in electrical manner with the third blocking capacitor; the first and second coaxial harmonic oscillator type band pass filters are disposed in a box including a base body, a cover plate and a cover body; the two coaxial harmonic oscillator type band pass filters are located on the base body and spaced each other by a metal plate; the multiplexer port, first and second ports are positioned on a lateral side of the base body; the first and second blocking capacitors are contained in the coaxial chambers of the two coaxial harmonic oscillator type band pass filters; the cover plate is secured on the base body; the first and second direct current circuits are placed on the cover plate; the low pass filters of the first and second direct current circuits are each fixed on an edge of a top surface of a corresponding coaxial chamber in the corresponding coaxial harmonic oscillator type band pass filter by means of a support member; and the cover body and the base body are fastened with each other.

2. The dual frequency multiplexer according to claim 1, wherein each of the blocking capacitors is a distributed parameter capacitor.

3. The dual frequency multiplexer according to claim 2, wherein each blocking capacitor includes an inner conductor, an insulator and a sleeve; the insulator surrounds the inner conductor at an outer perimeter of the inner conductor, while the sleeve surrounds the insulator at an outer perimeter of the insulator; the sleeve serves to electrically connect the first and/or second coaxial harmonic oscillator type band pass filter; the inner conductor is used to connect electrically with the first and/or second direct current circuits so as to be connected with an adjacent port.

4. The dual frequency multiplexer according to claim 1, wherein the first coaxial harmonic oscillator type band pass filter has a plurality of harmonic posts arranged in its own chamber sequentially, and the second coaxial harmonic oscillator type band pass filter has a plurality of harmonic posts arranged in its own chamber sequentially.

5. The dual frequency multiplexer according to claim 4, wherein for the two coaxial harmonic oscillator type band pass filters, a ridge is disposed between two adjacent harmonic posts for the purpose of enhancing coupling effect.

6. The dual frequency multiplexer according to claim 5, wherein the first coaxial harmonic oscillator type band pass filter has 5 harmonic posts, and the second coaxial harmonic oscillator type band pass filter has 6 harmonic posts.

7. The dual frequency multiplexer according to claim 6, wherein corresponding to the two coaxial harmonic oscillator type band pass filters, the cover plate has a plurality of turning screws which pass through the cover plate and extend into the two coaxial chambers, the turning screws provide for adjustment of tuning frequency and coupling degree of the coaxial harmonic oscillators.

8. The dual frequency multiplexer according to claim 7, wherein a gap with a width not less than 0.2 mm is defined between the top surface of the support member and a bottom surface of the cover plate.

9. The dual frequency multiplexer according to claim 8, wherein the cover plate has a through hole defined therein with which a Gore permeable film is covered.

* * * * *